US005932529A

United States Patent [19]

Storey

[11] Patent Number: 5,932,529

[45] Date of Patent: Aug. 3, 1999

[54] WINDSHIELD WASHER FLUIDS

[75] Inventor: Lyle E. Storey, Westlake, Ohio

[73] Assignee: Visible Solutions, Inc., Cleveland, Ohio

[21] Appl. No.: 08/888,576

[22] Filed: Jul. 7, 1997

[51] Int. Cl.[6] ..... C11D 7/26

[52] U.S. Cl. ..... 510/182; 510/180; 510/405; 510/419; 134/34

[58] Field of Search ..... 510/180, 181, 510/782, 405, 419; 106/13; 134/34

[56] References Cited

U.S. PATENT DOCUMENTS

| | | |
|---|---|---|
| 2,386,106 | 10/1945 | Gangloff . |
| 3,463,735 | 8/1969 | Stonebraker et al. . |
| 3,696,042 | 10/1972 | Wright . |
| 3,989,633 | 11/1976 | Frisque . |
| 4,606,842 | 8/1986 | Keyes et al. . |
| 4,666,621 | 5/1987 | Clark et al. . |
| 4,673,523 | 6/1987 | Smith et al. . |
| 5,043,088 | 8/1991 | Falla . |
| 5,342,549 | 8/1994 | Michael . |
| 5,415,811 | 5/1995 | Wile et al. . |
| 5,435,935 | 7/1995 | Kupneski . |
| 5,523,024 | 6/1996 | Garabedian, Jr. et al. . |
| 5,540,865 | 7/1996 | Michael . |

FOREIGN PATENT DOCUMENTS

| | | |
|---|---|---|
| 3-31388 | 2/1991 | Japan . |

OTHER PUBLICATIONS

ARCO Chemical Co., "Performance Chemicals, Technical Data, Automotive Windshield Cleaner Meets Low V.O.C. Requirements", 1997, pp. 1–2.

Material Safety Data Sheet for Prestone Windshield De–Icer Washer Fluid, 6 pages, Prestone Products Corporation, Danbury, CT. MSDS Date of Preparation/Revision: Jun. 4, 1997.

Labels (front and back) (marked "Container 1") from container of Peak Performance Products Premium Windshield Fluid Deicer & Cleaner, Distributed by Old World Industries, Inc., Northbrook, Illinois 60062–1851, phone number (847) 559–2000. This container was purchased in Ohio on Feb. 20, 1998.

Labels (front and back) (marked "Container 2") from container of Peak Performance Products Premium Windshield Fluid Deicer & Cleaner, Distributed by Old World Industries, Inc., Northbrook, Illinois 60062–1851, phone number (847) 559–2000. This container was purchased in Ohio on February 20, 1998.

Material Safety Data Sheet for Peak Performance Products Windshield Washer Fluid, 4 pages, Old World Industries, Inc., Northbrook, IL, Effective Date: Dec. 29, 1997.

Derwent (WPAT) Abstract of JP 03–031388, AN 91–084581/12, Feb. 12, 1991, Nippon Oil KK.

Derwent (WPAT) Abstract of JP 55125181 and JP88037151, AN 80–80067C/45, Sep. 26, 1980, Wako Pure Chem. Ind. KK and Jul. 22, 1988, Koike Kagaku KK, respectively.

Derwent (WPAT) Abstract of US 4,209,415, AN 80–49614C/28, Jun. 24, 1980, Basf Wayndotte Corp.

Derwent (WPAT) Abstract of JP 61113681 and JP 88067826, AN 86–179942/28, May 31, 1986 and Dec. 27, 1988, respectively, Tsukasa Doro KK.

Derwent (WPAT) Abstract of JP 59204694, AN 85–089178/15, Nov. 20, 1984, Yokkaichi Gosei KK.

Ww et al "Prediction of Flash Points of Solvent Mixtures," FATIPE'c–Kongr, vol. IV ($19^{th}$) pp. 227–236.

*Primary Examiner*—Margaret Einsmann

*Attorney, Agent, or Firm*—Pearne, Gordon, McCoy & Granger LLP

[57] ABSTRACT

An aqueous windshield washer fluid including 18 to about 33% by volume methanol, 1–14% by volume propylene glycol and the balance water and preferably surfactant and colorant. The fluid has a flash point over 100° F., making it a combustible liquid rather than a more hazardous flammable liquid.

41 Claims, No Drawings

WINDSHIELD WASHER FLUIDS

FIELD OF THE INVENTION

The invention relates generally to windshield washer fluids and more particularly to windshield washer fluids having a flash point above 100° F.

DESCRIPTION OF RELATED ART

For many years automobiles and trucks have been equipped with windshield washers. These washers operate by pumping a small jet of an aqueous fluid over the area of the windshield normally contacted by the windshield wipers. The windshield wipers then wipe the fluid across the windshield to clean off dirt, grime, snow, bug juice, bird droppings, etc.

Windshield washer fluids are generally an aqueous solution containing a water-soluble alcohol to depress the freezing point, a surfactant for lubricating, and a colorant. A typical known windshield washer fluid contains 38% by volume methanol with the balance being water, a small amount of surfactant and a small amount of colorant. This fluid has a freezing point of −20° F. (thus applicable for wintertime use) and a flash point of about 93° F. (using the Tagliabue closed cup method ("TCC")). Another known windshield washer fluid is believed to contain about 38% by volume methanol and about 5% by volume ethylene glycol and have a flash point of about 88° F. (TCC).

Liquids which have a flash point below 100° F. (TCC) are classified as flammable while those with a flash point above 100° F. (TCC) are classified as combustible. Combustible is a less hazardous classification than flammable. Flammable liquids are considered dangerous or hazardous by the National Fire Protection Association, local fire marshals, the U.S. Department of Transportation ("DOT"), and the Occupational Safety and Health Administration ("OSHA"). Flammable liquids are considered more hazardous than combustible liquids and are accordingly more heavily regulated and are required to be kept in more secure or safer containers.

There is a need for a windshield washer fluid which is a combustible liquid rather than a flammable liquid, that is, which has a flash point above 100° F., so that it can be less hazardous, less regulated, and more easily and safely transported, stored, and used. There is also a need for such windshield washer fluids which have freezing points at 0° F., −10° F., −20° F., −25° F., −30° F., and −40° F. for wintertime use.

SUMMARY OF THE INVENTION

A windshield washer fluid comprising methanol, propylene glycol and water is provided. The fluid is an aqueous solution which is 18 to about 33% by volume methanol, 1–14% by volume propylene glycol and at least 56% by volume water. The fluid has a flash point over 100° F.

DETAILED DESCRIPTION OF THE PREFERRED EMBODIMENTS OF THE INVENTION

As used herein and in the claims, parts are parts by volume and percentages are percent by volume, unless specifically specified otherwise. As used in the claims, flash point means closed cup flash point as determined according to ASTM D3278 (the version current as of May 1, 1997), and freezing point or freeze point means freezing point or solidification point as determined according to ASTM D1493 (the version current as of May 1, 1997).

The methanol (methyl alcohol) used herein is preferably commercial grade, being 99 or 99+% pure. The propylene glycol (1,2-Propanediol) used is preferably industrial grade or 99 or 99+% pure. The water is preferably filtered. These three ingredients preferably make up at least 96%, more preferably at least 97%, more preferably at least 98%, more preferably at least 99%, more preferably at least 99.9%, of the invented fluid. As will be shown, it is the relative proportions of these three ingredients which determine the flash and freezing points.

The present invention optionally and preferably includes a small amount of surfactant to act as a lubricant or wetting agent or detergent to improve the cleaning efficiency of the water/alcohol mixture. Windshield washer fluid surfactants are known in the art and include sodium dioctyl sulfosuccinate, available from Rhone Poulenc as Geropon SS-0-75 and from Arco as Aerosol OT-75. Other surfactants known in the art may be used. The surfactant is added at a rate of less than 2% or 1%, more preferably less than 0.1%, more preferably about 0.001–0.01%.

The present invention optionally and preferably includes a small amount (less than 0.1%, more preferably less than 0.01%, more preferably less than 0.001%) of water-soluble colorant or dye, such as Pylaklor Window Spray Blue S-405 from Pylam Products Co., Inc., Tempe, Ariz. or other water-soluble colorant known in the art. Other components for windshield washer fluid are also known in the art.

The invented windshield washer fluid is 18 to about 33%, more preferably 19 to about 32%, more preferably 20 to about 31%, more preferably 20–31%, more preferably 22–31%, more preferably 24–31%, more preferably 22–30%, more preferably 24–30%, more preferably 26–30%, more preferably 28–30%, more preferably 29–31%, more preferably 29–30%, more preferably about 30%, more preferably 30%, methanol, and 1–14%, more preferably 1–11%, more preferably 1–9%, more preferably 1–8%, more preferably 2–8%, more preferably 1–7%, more preferably 2–6%, more preferably 2–5%, propylene glycol. The balance is water and optionally and preferably surfactant and colorant. The methanol and propylene glycol are combined with water and preferably a surfactant and a colorant to form an aqueous solution having a flash point over 100° F. and preferably about 101–102° F., more preferably 101–102° F. or 101° F. or 102° F., preferably over 100° F. and not over 104° F. or 103° F. or 102° F. or 101° F.

The invented fluid is at least 50% water, more preferably at least 56% water, more preferably at least 60% water, or alternatively at least the % water indications tested in the Examples herein.

Reducing the percentage of methanol raises the flash point but also raises the freezing point. Adding propylene glycol lowers the freezing point with only a minor effect on the flash point. The freezing point of the invented fluid is preferably 0° F. or lower, more preferably −10° F. or lower (ie., not higher than −10° F.), more preferably −20° F. or lower, optionally −25° F. or lower, −30° F. or lower, −35° F. or lower, or −40° F. or lower, depending on the area of the country where the fluid is sold and used and how cold it gets there in the winter.

The preferred invented formulation is 30% methanol, 5% propylene glycol, 0.001% Geropon SS-0-75 surfactant, 0.0005% Pylaklor Window Spray Blue S-405 colorant, and the balance (65%) water, which has a closed cup flash point of 102° F. and a freezing point below −30° F. Less preferred formulations have the same volume percentages of surfactant and colorant, and the following volume percentages of the other components:

30% methanol, 7% propylene glycol, 63% water (Flash Point 101° F., freezing point less than −30° F.);

30% methanol, 2% propylene glycol, 68% water;

30% methanol, 3% propylene glycol, 67% water;

30% methanol, 4% propylene glycol, 66% water;

30% methanol, 6% propylene glycol, 64% water; and

30% methanol, 8% propylene glycol, 62% water.

A further less preferred formation is 22% methanol, 1% propylene glycol, and 77% water. As can be seen, these formulations are free from the presence of 1) one or more ethers and 2) isopropyl alcohol, particularly in volume percentages of at least 1%, 2%, 3%, 5% or 10%.

The ingredients are mixed together and put into a windshield washer fluid reservoir of an automobile or truck. The fluid is then used to clean the windshield. The freezing point is selected so the fluid will not freeze in the winter. A further advantage of the invention is that it can be stored in a bulk or large storage container (such as a container larger than 1 gallon, preferably larger than 10 gallons, preferably larger than 25 gallons, including 55 gallon drums or 100 gallon containers and larger, including 100–600 gallon storage containers and larger, including 600–2000 gallon storage containers and larger) in a quick oil change shop, car rental facility, trucking company, or other automotive vehicle service station or center or other large user of windshield washer fluid without violating i fire code regulations in many locations which prohibit such bulk storage of flammable liquids but which permit such storage of combustible liquids.

There is test data that solutions consisting of methanol and water have about the following flash points (TCC method): 32% methanol: 99° F.; 31% methanol: 100° F.; 30% methanol: 101° F.; 29% methanol: 102° F. A 30% methanol solution freezes at about −6° F.

The following Examples further illustrate various aspects of the invention.

EXAMPLES

Samples were prepared by combining methanol, propylene glycol and water in the indicated proportions and tested. Closed cup flash points were determined according to ASTM D3278 and freezing points were determined according to an abbreviated version of ASTM D1493. Percents are by volume.

| Percent Methanol | Percent Propylene Glycol | Percent Water | Closed Cup Flash Point, ° F. | Freezing Point, ° F. |
|---|---|---|---|---|
| 22 | 1 | 77 | 111 | 0 |
| 22 | 5 | 73 | 111 | 0 |
| 22 | 10 | 68 | 109 | −4 |
| 26 | 1 | 73 | 108 | −18 |
| 26 | 2 | 72 | 108 | −20 |
| 26 | 3 | 71 | 107 | −25 |
| 26 | 4 | 70 | 108 | −25 |
| 26 | 5 | 69 | 108 | −25 |
| 26 | 6 | 68 | 107 | <−30 |
| 26 | 7 | 67 | 107 | <−30 |
| 26 | 8 | 66 | 108 | <−30 |
| 26 | 9 | 65 | 108 | <−30 |
| 26 | 10 | 64 | 107 | <−30 |
| 28 | 2 | 70 | 103 | −23 |
| 28 | 5 | 67 | 102 | −29 |
| 28 | 10 | 62 | 99 | <−30 |
| 30 | 1 | 69 | 102 | −20 |
| 30 | 2 | 68 | 102 | −24 |

-continued

| Percent Methanol | Percent Propylene Glycol | Percent Water | Closed Cup Flash Point, ° F. | Freezing Point, ° F. |
|---|---|---|---|---|
| 30 | 3 | 67 | 101 | −28 |
| 30 | 4 | 66 | 102 | <−30 |
| 30 | 5 | 65 | 102 | <−30 |
| 30 | 6 | 64 | 102 | <−30 |
| 30 | 7 | 63 | 101 | <−30 |
| 30 | 8 | 62 | 101 | <−30 |
| 30 | 9 | 61 | 99 | <−30 |
| 30 | 10 | 60 | 100 | <−30 |
| 30 | 11 | 59 | 99 | <−36 |
| 30 | 12 | 58 | 97 | <−36 |
| 30 | 13 | 57 | 96 | <−36 |
| 30 | 14 | 56 | 96 | <−36 |
| 30 | 15 | 55 | 96 | <−36 |

For comparison, ethylene glycol was substituted for propylene glycol in certain formulations and showed the following results.

| Percent Methanol | Percent Propylene Glycol | Percent Water | Closed Cup Flash Point, ° F. | Freezing Point, ° F. |
|---|---|---|---|---|
| 28 | 5 | 67 | 100 | −27 |
| 30 | 5 | 65 | 96 | <−30 |
| 30 | 7 | 63 | 95 | <−30 |
| 30 | 9 | 61 | 94 | <−30 |

The above Examples show that propylene glycol, when added in small amounts as indicated, does not lower the flash point very much and significantly lowers the freezing point. When ethylene glycol is substituted for propylene glycol, ethylene glycol (a) lowers the flash point noticeably more than propylene glycol does, and (b) in the first sample (28%), raises the freezing point. Propylene glycol surprisingly performs better than ethylene glycol. The use of propylene glycol in the present invention permits a flash point above 100° F. to be maintained (which is important so that the fluid is a combustible liquid rather than a flammable liquid), and permits freezing points of 0° F. to −40° F. to be effectively obtained.

Although the preferred embodiments have been described, it is understood that other embodiments of the components and methods may be resorted to without departing from the scope of the invention as disclosed and claimed herein.

What is claimed is:

1. A windshield washer fluid comprising methanol, propylene glycol and water, said fluid being an aqueous solution which is 18 to about 33% by volume methanol, 1–14% by volume propylene glycol and at least 56% by volume water, said fluid having a flash point over 100° F.

2. A fluid according to claim 1, said fluid having a freezing point not higher than 0° F.

3. A fluid according to claim 2, further comprising a surfactant.

4. A fluid according to claim 1, said fluid being 20–31% by volume methanol, 1–11% by volume propylene glycol, and at least 60% by volume water.

5. A fluid according to claim 2, said fluid being 22–31% by volume methanol, 1–9% by volume propylene glycol, and at least 60% by volume water.

6. A fluid according to claim 4, said fluid having a freezing point not higher than −20° F.

7. A fluid according to claim 4, said fluid having a freezing point not higher than −30° F.

8. A fluid according to claim 1, said fluid being 20–31% by volume methanol, said fluid having a freezing point not higher than −40° F.

9. A fluid according to claim 4, further comprising a surfactant, said methanol, propylene glycol and water together forming at least 99% by volume of said fluid.

10. A fluid according to claim 7, further comprising a surfactant.

11. A fluid according to claim 6, said fluid being 29–31% by volume methanol and 1–8% by volume propylene glycol.

12. A fluid according to claim 11, said fluid being about 30% by volume methanol.

13. A fluid according to claim 12, further comprising (a) a surfactant present at a rate of less than 1% by volume, and (b) a colorant.

14. A fluid according to claim 1, said fluid having a flash point not over 103° F.

15. A fluid according to claim 1, said fluid consisting essentially of said methanol, propylene glycol and water.

16. A fluid according to claim 5, said fluid being 26–30% by volume methanol, 1–8% by volume propylene glycol, and having a freezing point not higher than −10° F.

17. A fluid according to claim 12, said fluid being 2–5% by volume propylene glycol.

18. A fluid according to claim 9, said fluid being about 30% by volume methanol and 2–5% by volume propylene glycol.

19. A fluid according to claim 9, said fluid being 26–30% by volume methanol, 1–8% by volume propylene glycol, and having a freezing point not higher than −10° F.

20. A fluid according to claim 19, further comprising a colorant.

21. A method for cleaning a windshield on an automobile comprising applying to said windshield a windshield washer fluid, said fluid being an aqueous solution which is 18 to about 33% by volume methanol, 1–14% by volume propylene glycol and at least 56% by volume water, said fluid having a flash point over 100° F.

22. A method according to claim 21, said fluid having a freezing point not higher than 0° F.

23. A method according to claim 22, said fluid further comprising a surfactant.

24. A method according to claim 21, said fluid being 20–31% by volume methanol, 1–11% by volume propylene glycol, and at least 60% by volume water.

25. A method according to claim 22, said fluid being 22–31% by volume methanol, 1–9% by volume propylene glycol, and at least 60% by volume water.

26. A method according to claim 24, said fluid having a freezing point not higher than −20° F.

27. A method according to claim 24, said fluid having a freezing point not higher than −30° F.

28. A method according to claim 21, said fluid being 20–31% by volume methanol, said fluid having a freezing point not higher than −40° F.

29. A method according to claim 24, said fluid further comprising a surfactant, said methanol, propylene glycol and water together forming at least 99% by volume of said fluid.

30. A method according to claim 27, said fluid further comprising a surfactant.

31. A method according to claim 26, said fluid being 29–31% by volume methanol and 1–8% by volume propylene glycol.

32. A method according to claim 31, said fluid being about 30% by volume methanol.

33. A method according to claim 32, said fluid further comprising (a) a surfactant present at a rate of less than 1% by volume, and (b) a colorant.

34. A method according to claim 21, said fluid having a flash point not over 103° F.

35. A method according to claim 21, said fluid consisting essentially of said methanol, propylene glycol and water.

36. A method according to claim 25, said fluid being 26–30% by volume methanol, 1–8% by volume propylene glycol, and having a freezing point not higher than −10° F.

37. A method according to claim 32, said fluid being 2–5% by volume propylene glycol.

38. A method according to claim 29, said fluid being about 30% by volume methanol and 2–5% by volume propylene glycol.

39. A method according to claim 29, said fluid being 26–30% by volume methanol, 1–8% by volume propylene glycol, and having a freezing point not higher than −10° F.

40. A method according to claim 39, said fluid further comprising a colorant.

41. A method according to claim 21, said method further comprising the step of wiping said fluid across said windshield to clean said windshield.

* * * * *

UNITED STATES PATENT AND TRADEMARK OFFICE

CERTIFICATE OF CORRECTION

PATENT NO. : 5,932,529
DATED : August 3, 1999
INVENTOR(S) : Lyle E. Storey

It is certified that error appears in the above-identified patent and that said Letters Patent is hereby corrected as shown below:

On the title page, under Other Publications, 11th reference, line 1 "Ww" should be --Wu--.

On the title page, under Other Publications, 11th reference, line 2 after "227-236" insert --, 1998--.

Column 3, line 28 after "violating" delete --i--.

Signed and Sealed this

Eighth Day of February, 2000

*Attest:*

*Attesting Officer*

Q. TODD DICKINSON

*Commissioner of Patents and Trademarks*